US008966676B2

(12) United States Patent
Hamakita et al.

(10) Patent No.: US 8,966,676 B2
(45) Date of Patent: Mar. 3, 2015

(54) TOILET APPARATUS

(75) Inventors: Aki Hamakita, Fukuoka-ken (JP); Yo Morotomi, Fukuoka-ken (JP); Koichiro Matsushita, Fukuoka-ken (JP); Shuichi Nagashima, Fukuoka-ken (JP)

(73) Assignee: Toto Ltd, Kitakyushu-Shi (JP)

( * ) Notice: Subject to any disclaimer, the term of this patent is extended or adjusted under 35 U.S.C. 154(b) by 0 days.

(21) Appl. No.: 14/006,444

(22) PCT Filed: Mar. 26, 2012

(86) PCT No.: PCT/JP2012/057740

§ 371 (c)(1),
(2), (4) Date: Oct. 30, 2013

(87) PCT Pub. No.: WO2012/133298

PCT Pub. Date: Oct. 4, 2012

(65) Prior Publication Data

US 2014/0059757 A1 Mar. 6, 2014

(30) Foreign Application Priority Data

Mar. 30, 2011 (JP) ..... 2011-074214

(51) Int. Cl.
*E03D 11/00* (2006.01)
*E03D 9/00* (2006.01)

(52) U.S. Cl.
CPC . *E03D 9/005* (2013.01); *E03D 9/00* (2013.01)
USPC ..... 4/420

(58) Field of Classification Search
CPC ..... E03D 11/02
USPC ..... 4/420
See application file for complete search history.

(56) References Cited

U.S. PATENT DOCUMENTS

| | | | |
|---|---|---|---|
| 2011/0030133 | A1 | 2/2011 | Morotomi |
| 2011/0145985 | A1 | 6/2011 | Lin |

FOREIGN PATENT DOCUMENTS

| | | | |
|---|---|---|---|
| EP | 1 473 355 | A1 | 11/2004 |
| EP | 2 226 439 | A2 | 9/2010 |
| JP | 2000-144846 | A | 5/2000 |
| JP | 2000-265527 | A | 9/2000 |
| JP | 2008-163716 | A | 7/2008 |
| KR | 10-0701228 | B1 | 3/2007 |
| TW | 2009-25361 | | 6/2009 |
| TW | M386321 | U1 | 8/2010 |

OTHER PUBLICATIONS

Office Action issued in corresponding Taiwanese Patent Application No. 101106014 dated Apr. 9, 2014.
Extended European Search Report issued in Application No. EP 12 76 5690 dated Jul. 18, 2014.

*Primary Examiner* — Lori Baker
(74) *Attorney, Agent, or Firm* — Pearne & Gordon LLP

(57) ABSTRACT

According to an aspect of the invention, a toilet apparatus includes a toilet, a bowl configured to receive solid waste being formed in the toilet, the bowl being hydrophilic; a spray unit configured to spray at least one selected from water and hypochlorous acid water onto a surface of the bowl; a detection unit configured to detect a state of use of the toilet; and a control unit configured to spray at least one selected from the water and the hypochlorous acid water from the spray unit before the use and to spray the hypochlorous acid water from the spray unit after the use. The cleanliness of the bowl surface of a toilet can be maintained by suppressing the affixation of solid waste and the propagation of bacteria caused by oil.

4 Claims, 12 Drawing Sheets

| SAMPLE | SURFACE PROPERTY | SURFACE STATE | SURFACE PHOTOGRAPH | REMOVAL TIME (SECONDS) |
|---|---|---|---|---|
| (1) | HYDROPHILIC (WITHOUT SPRAY BEFORE USE) | 601 810 | | 13 |
| (2) | HYDROPHILIC (WITH SPRAY BEFORE USE) | 601 653 810 | | 9 |
| (3) | SUPER-HYDROPHILIC (FIRST COMPARATIVE EXAMPLE) | 601 653 810a | | 5 |
| (4) | BIOFILM (SECOND COMPARATIVE EXAMPLE) | 601 657 810b | | 294 |
| (5) | BIOFILM (THIRD COMPARATIVE EXAMPLE) | 601 657 810b | | 90 |

FIG. 7

TOILET APPARATUS

TECHNICAL FIELD

An aspect of the invention relates generally to a toilet apparatus, and specifically to a toilet apparatus capable of sterilizing or washing a toilet.

BACKGROUND

When solid waste strikes the bowl surface of a toilet, a fatty acid which is one component of feces adheres to the bowl surface. When general toilet washing is executed, on the one hand, the solid components of the feces are rinsed away; but there are cases where oil such as the fatty acids, etc., included in the feces remains on the bowl surface. In such a case, a film of the oil is formed on the bowl surface. Because the oil becomes a nutrient of bacteria, there is a risk that bacteria may propagate in the case where the oil remains on the bowl surface. In the case where the bacteria propagates, for example, bacteria and collections of secretions of the bacteria called biofilms and the like are formed. In the case where a biofilm is formed, the bowl surface becomes dull.

Also, there are cases where the feces affixes to the bowl surface when the solid waste strikes the bowl surface where the biofilm is formed. In such a case, it becomes difficult to peel the solid components of the feces from the bowl surface by general toilet washing. Therefore, there are cases where the solid waste remains on the bowl surface.

Conversely, there exist a commode and a toilet seat apparatus that include a nozzle mechanism configured to dispense hypochlorous acid (Patent Document 1). However, in the case where the nozzle mechanism recited in Patent Document 1 dispenses the hypochlorous acid after the user has used the toilet, the dispensed amount of the hypochlorous acid is relatively higher. Therefore, the life of the electrolytic cell that produces the hypochlorous acid is relatively shorter. On this point, there is room for improvement.

Further, there is a private part cleansing apparatus that includes a dispensed water property control unit for which the user can control the dispensing temperature and a detergent mixture amount of the dispensed water, and an automatic pre-wash control unit to automatically pre-wash the interior of the toilet using a toilet washing nozzle (Patent Document 2). In the private part cleansing apparatus recited in Patent Document 2, prescribed effects can be expected for the adhered dirt of the visually-confirmable solid waste. However, there is a risk that the oil such as the fatty acids, etc., included in the feces may remain on the bowl surface. On this point, there is room for improvement.

CITATION LIST

Patent Literature

[Patent Document 1] JP 2000-144846 A (Kokai)
[Patent Document 2] JP 2000-248601 A (Kokai)

SUMMARY OF INVENTION

Technical Problem

The invention was made in consideration of the relevant problems and has an object of providing a toilet apparatus that can maintain the cleanliness of the bowl surface of a toilet by suppressing the affixation of solid waste and the propagation of bacteria caused by oil.

Solution to Problem

According to an aspect of the invention, a toilet apparatus includes a toilet, a bowl configured to receive solid waste being formed in the toilet, the bowl being hydrophilic; a spray unit configured to spray at least one selected from water and hypochlorous acid water onto a surface of the bowl; a detection unit configured to detect a state of use of the toilet; and a control unit configured to control the spray unit before use of the toilet and after the use of the toilet based on a detection result of the detection unit to spray at least one selected from the water and the hypochlorous acid water from the spray unit before the use and to spray the hypochlorous acid water from the spray unit after the use.

BRIEF DESCRIPTION OF DRAWINGS

FIG. 7 is a result table illustrating an example of results of experiments performed by the inventor for the removal time of solid waste.

DESCRIPTION OF EMBODIMENTS

Figure 1:
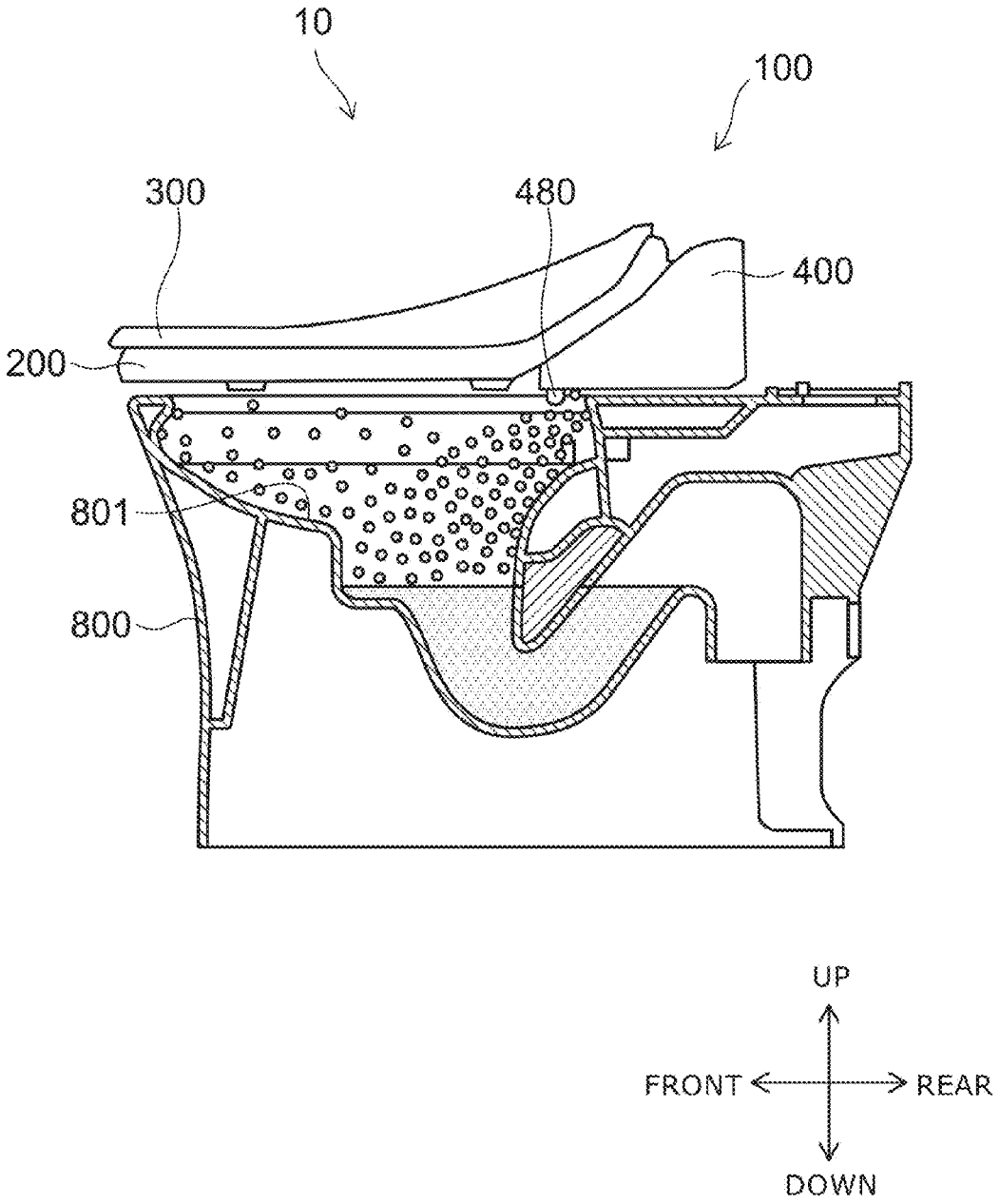
FIG. 1 is a schematic view illustrating the toilet apparatus according to the embodiment of the invention.

A first invention is a toilet apparatus including: a toilet, a bowl configured to receive solid waste being formed in the toilet, the bowl being hydrophilic; a spray unit configured to spray at least one selected from water and hypochlorous acid water onto a surface of the bowl; a detection unit configured to detect a state of use of the toilet; and a control unit configured to control the spray unit before use of the toilet and after the use of the toilet based on the detection result of the detection unit to spray at least one selected from the water and the hypochlorous acid water from the spray unit before the use and to spray the hypochlorous acid water from the spray unit after the use.

According to this toilet apparatus, the bowl of the toilet is hydrophilic. The control unit executes a control to spray at least one selected from the water and the hypochlorous acid water from the spray unit before the use of the toilet based on the detection result of the detection unit configured to detect the state of use of the toilet. Thereby, a water film is formed on the surface of the bowl before the use of the toilet. Therefore, the adhesion or affixation of solid waste onto the surface of the bowl can be suppressed.

Also, the control unit executes a control to spray the hypochlorous acid water from the spray unit after the use of the toilet based on the detection result of the detection unit configured to detect the state of use of the toilet. Because the bowl is hydrophilic, the hypochlorous acid water can exist around the oil of the solid waste adhered to the surface of the bowl. Thereby, the oil of the solid waste adhered to the surface of the bowl can be efficiently decomposed; and the solid waste remaining on the surface of the bowl can be suppressed. Further, the formation of the covering film of the oil on the surface of the bowl due to the oil of the solid waste remaining on the surface of the bowl can be suppressed. Therefore, the affixation of the solid waste and the propagation of the bacteria caused by the oil of the solid waste can be suppressed; and the cleanliness of the surface of the bowl can be maintained.

A second invention is the toilet apparatus of the first invention wherein the spray unit is a nozzle configured to spray the water and the hypochlorous acid water in a mist-like form.

According to this toilet apparatus, the mist unit is configured to spray the water and the hypochlorous acid water in a mist-like form. Therefore, the water and the hypochlorous acid water sprayed from the mist unit adheres evenly to a wider range of the surface of the bowl. Thereby, the adhesion or affixation of the solid waste to the surface of the bowl can be suppressed more efficiently. Also, the sterilizing water sprayed from the mist unit can be positioned around the solid waste remaining on the surface of the bowl. Therefore, the oil of the solid waste adhered to the surface of the bowl can be decomposed more efficiently.

A third invention is the toilet apparatus of the first invention wherein the contact angle of oleic acid in water on the surface of the bowl is not less than 90 degrees.

According to this toilet apparatus, the contact angle of oleic acid in water on the surface of the bowl is not less than 90 degrees. Therefore, the water and the hypochlorous acid water can exist around the oil of the solid waste. Therefore, the oil of the solid waste is easily peeled from the surface of the bowl. Alternatively, the oil of the solid waste is easily decomposed by the hypochlorous acid. Thereby, the nutrient residual ratio of the surface of the bowl can be reduced. Further, the affixation of the solid waste and the propagation of the bacteria caused by the oil of the solid waste can be suppressed; and the cleanliness of the surface of the bowl can be maintained.

A fourth invention is the toilet apparatus of the first invention wherein the arithmetic average roughness Ra of the surface of the bowl is not more than 0.07 μm.

According to this toilet apparatus, the arithmetic average roughness Ra of the surface of the bowl is not more than 0.07 μm. Thereby, the contact angle of oleic acid in water on the surface of the bowl increases. On the other hand, the contact angle of the water on the surface of the bowl decreases. Therefore, a water film can be reliably formed by the surface of the bowl; and the water and the hypochlorous acid water can exist around the oil of the solid waste. Therefore, the oil of the solid waste is easily peeled from the surface of the bowl. Alternatively, the oil of the solid waste is easily decomposed by the hypochlorous acid. Thereby, the nutrient residual ratio of the surface of the bowl can be reduced. Further, the affixation of the solid waste and the propagation of the bacteria caused by the oil of the solid waste can be suppressed; and the cleanliness of the surface of the bowl can be maintained.

An embodiment of the invention will now be described with reference to the drawings. Similar components in the drawings are marked with like reference numerals; and a detailed description is omitted as appropriate.

FIG. 1 is a schematic view illustrating the toilet apparatus according to the embodiment of the invention.

Figure 2:
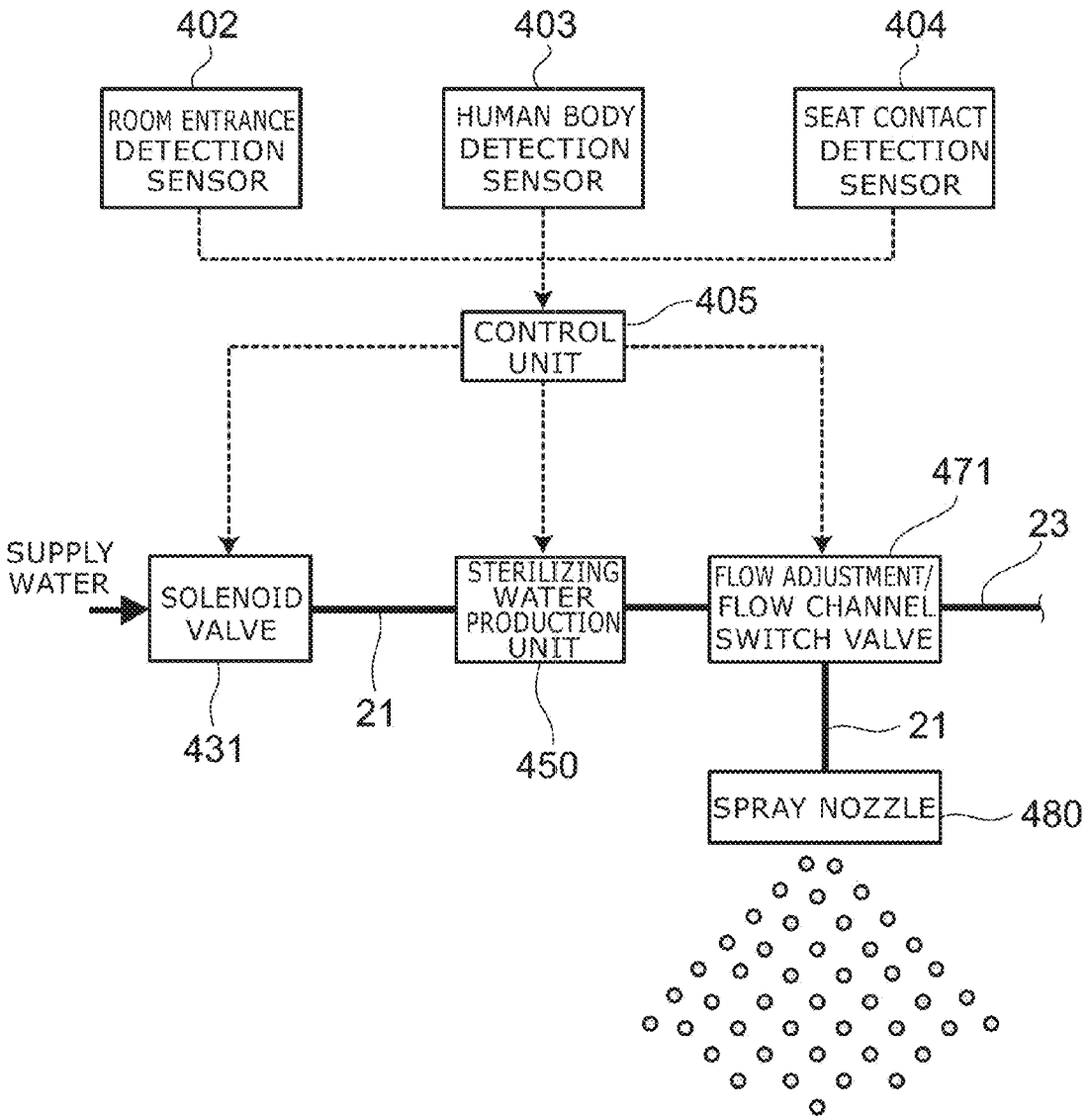
FIG. 2 is a block diagram illustrating the relevant components of the toilet apparatus according to this embodiment.

FIG. 2 is a block diagram illustrating the relevant components of the toilet apparatus according to this embodiment.

For convenience of description in FIG. 1, the schematic view illustrating the sanitary washing apparatus is a schematic plan view; and the schematic view illustrating the western-style sit-down toilet is a schematic cross-sectional view. FIG. 2 simultaneously illustrates the relevant components of the water path system and the electrical system.

The toilet apparatus 10 illustrated in FIG. 1 includes a western-style sit-down toilet (for convenience of description hereinbelow, called simply the "toilet") 800 and a sanitary washing apparatus 100 provided on the western-style sit-down toilet 800. The toilet 800 includes a bowl 801. The sanitary washing apparatus 100 includes a casing 400, a toilet seat 200, and a toilet lid 300. The toilet seat 200 is pivotally supported openably and closeably with respect to the casing 400; and the toilet lid 300 is pivotally supported openably and closeably with respect to the casing 400. It is not always necessary to provide the toilet lid 300.

The bowl 801 can receive solid waste excreted by a user. The surface of the bowl 801 is hydrophilic. Here, in the specification of the application, being hydrophilic refers to, for example, having an affinity to water that is higher than that of the bowl surface of a toilet formed of a resin such as acrylic, etc. Specifically, for example, in the case where contact angles of water are compared, a bowl surface can be said to be hydrophilic when the bowl surface has a contact angle that is smaller than the contact angle of water for the bowl surface of the toilet formed of the resin. The hydrophilic property of the surface of the bowl 801 of this embodiment is elaborated later.

For example, a spray nozzle (a spray unit) 480 that is configured to spray the water and/or the sterilizing water onto the surface of the bowl 801 of the toilet 800 is provided at the lower portion of the casing 400. The spray nozzle 480 can spray the water and/or the sterilizing water in a mist-like form. The spray nozzle 480 may be provided in the interior of the casing 400 and may be additionally provided outside the casing 400.

Water as referred to in the specification of the application includes not only cold water but also heated warm water. In the specification of the application, "sterilizing water" refers to a liquid such as, for example, hypochlorous acid or the like that includes more sterilizing components than does service water (which is also called simply "water").

As illustrated in FIG. 2, the toilet apparatus 10 according to this embodiment includes a first flow channel 21 that guides water supplied from a water supply source such as a service water line, a water storage tank, etc., to the spray nozzle 480. A solenoid valve 431 is provided on the upstream side of the first flow channel 21. The solenoid valve 431 is an openable and closable solenoid valve that controls the supply of the water based on a command from a control unit 405 provided in the interior of the casing 400. The first flow channel 21 is taken to be the secondary side on the side downstream from the solenoid valve 431.

A sterilizing water production unit 450 that is capable of producing sterilizing water is provided downstream of the solenoid valve 431. The sterilizing water production unit 450 is elaborated later. A flow adjustment/flow channel switch valve 471 is provided downstream of the sterilizing water production unit 450 to adjust the water force (the flow rate) and to open, close, and switch the supply water between the spray nozzle 480, a not-illustrated washing nozzle, and the like. The first flow channel 21 branches at the flow adjustment/flow channel switch valve 471. The sterilizing water and the tap water that are guided through the first flow channel 21 are guided into the spray nozzle 480 after passing through the flow adjustment/flow channel switch valve 471. On the other hand, the sterilizing water and the tap water guided into a second flow channel 23 that branches at the flow adjustment/flow channel switch valve 471 are guided into, for example, a not-illustrated washing nozzle, nozzle wash chamber, and the like. The flow adjustment/flow channel switch valve 471 can be switched between a state in which the sterilizing water and the tap water are guided into the first flow channel 21 and a state in which the sterilizing water and the tap water are guided into the second flow channel 23 based on a command from the control unit 405.

For example, a detection unit configured to detect the state of use of the toilet 800 is provided in the casing 400. More specifically, a room entrance detection sensor (a detection unit) 402 configured to detect the user entering the toilet room, a human body detection sensor (a detection unit) 403 configured to detect the user in front of the toilet seat 200, and a seat contact detection sensor (a detection unit) 404 configured to detect the user seated on the toilet seat 200 are provided in the casing 400.

The room entrance detection sensor 402 can detect the user directly after opening the door of the toilet room and entering the toilet room or the user existing in front of the door to enter the toilet room. That is, the room entrance detection sensor 402 can detect not only a user that has entered the toilet room but also a user before entering the toilet room, that is, a user existing in front of the door outside the toilet room. A pyroelectric sensor, a microwave sensor such as a doppler sensor, and the like can be used as such a room entrance detection sensor 402. In the case where a sensor utilizing the doppler effect of microwaves, a sensor configured to transmit a microwave and detect the object to be detected based on the amplitude (the strength) of the reflected microwave, or the like is used, it is possible to detect the existence of the user through the door of the toilet room. That is, the user can be detected before entering the toilet room.

The human body detection sensor 403 can detect the user in front of the toilet 800, that is, the user existing at a position frontward of the toilet seat 200 and distal to the toilet seat 200. That is, the human body detection sensor 403 can detect a user that has entered the toilet room and is approaching the toilet seat 200. For example, an infrared transmitting-and-receiving distance sensor and the like can be used as such a human body detection sensor 403.

The seat contact detection sensor 404 can detect a user seated on the toilet seat 200 or a human body existing above the toilet seat 200 right before the user is seated on the toilet seat 200. In other words, the seat contact detection sensor 404 can detect not only a user seated on the toilet seat 200 but also a user existing above the toilet seat 200. For example, an infrared transmitting-and-receiving distance sensor and the like can be used as such a seat contact detection sensor 404.

Figure 3A:
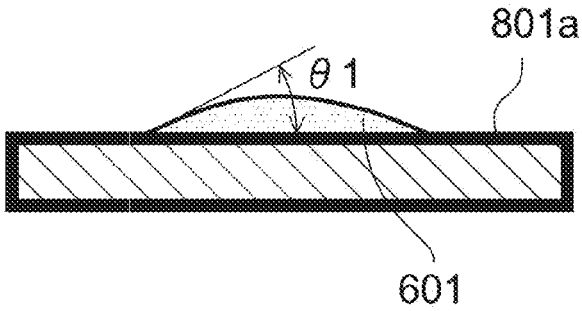
FIG. 3A to FIG. 3C are schematic cross-sectional views illustrating the bowl surface of a toilet apparatus according to a comparative example.
Figure 3B:
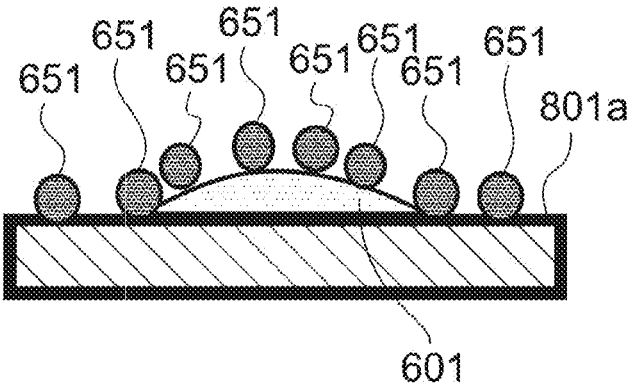
Figure 3C:
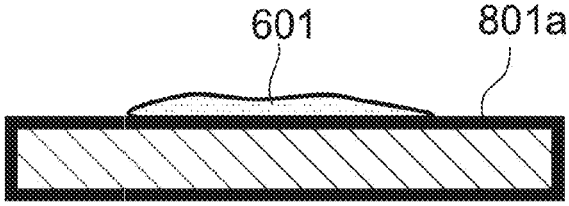

FIG. 3A to FIG. 3C are schematic cross-sectional views illustrating the bowl surface of a toilet apparatus according to a comparative example.

Figure 4A:
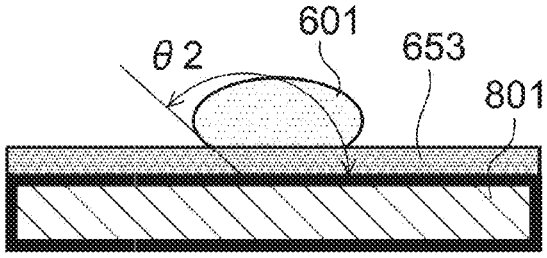
FIG. 4A to FIG. 4C are schematic cross-sectional views illustrating the bowl surface of the toilet apparatus according to this embodiment.
Figure 4B:
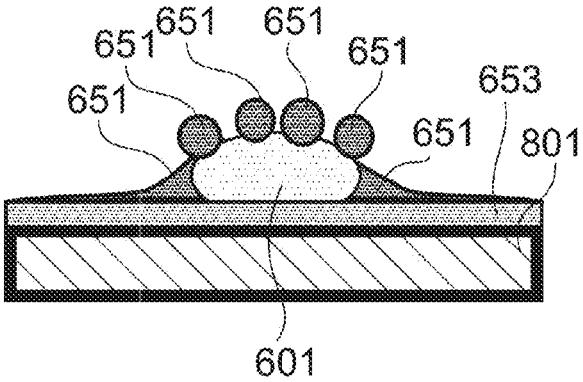
Figure 4C:
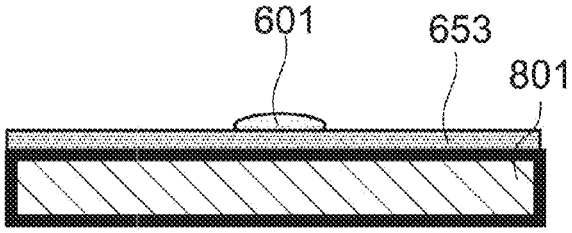

FIG. 4A to FIG. 4C are schematic cross-sectional views illustrating the bowl surface of the toilet apparatus according to this embodiment.

Figure 5:
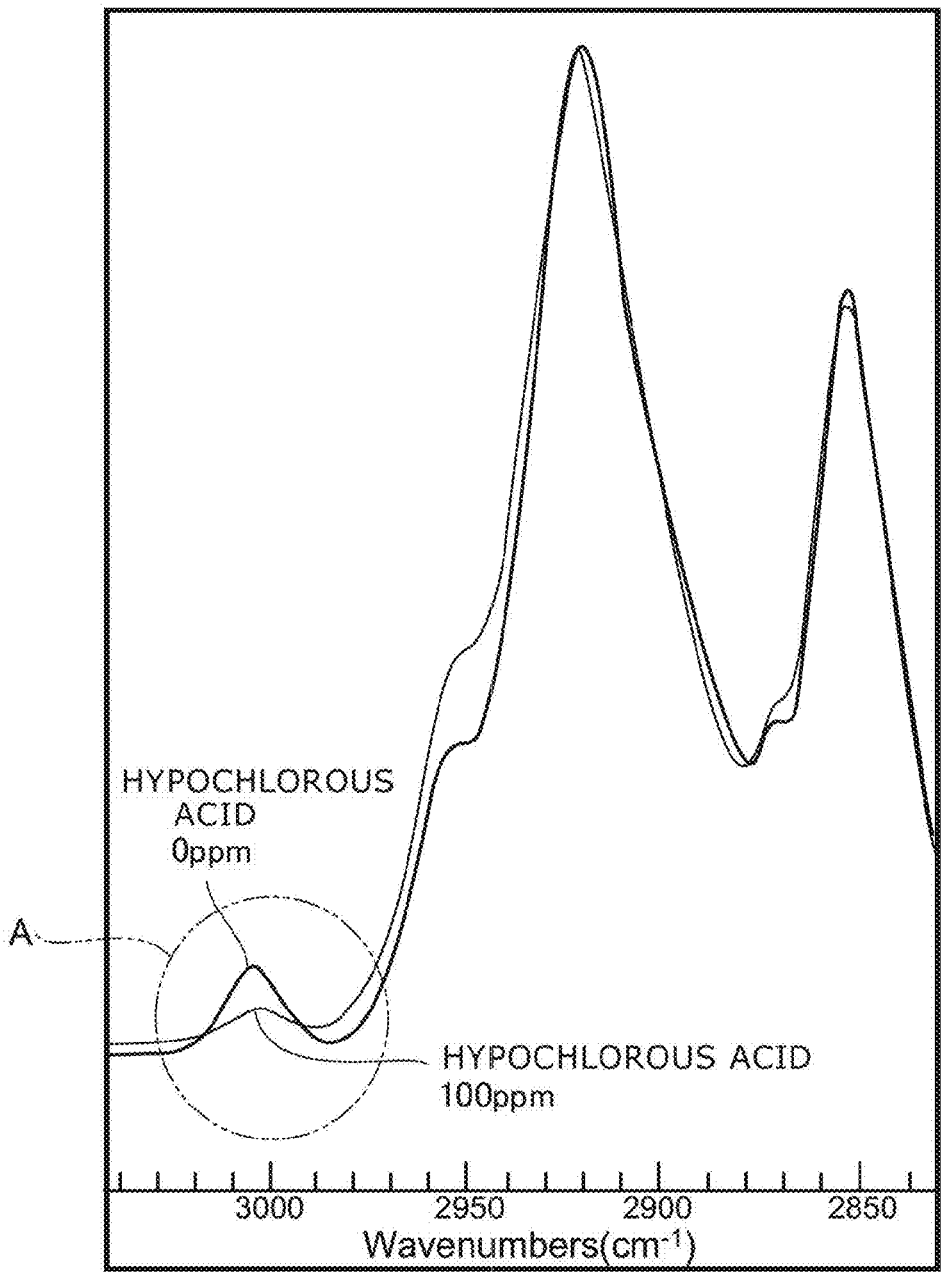
FIG. 5 is a graph illustrating decomposition effects of hypochlorous acid.
Figure 6:
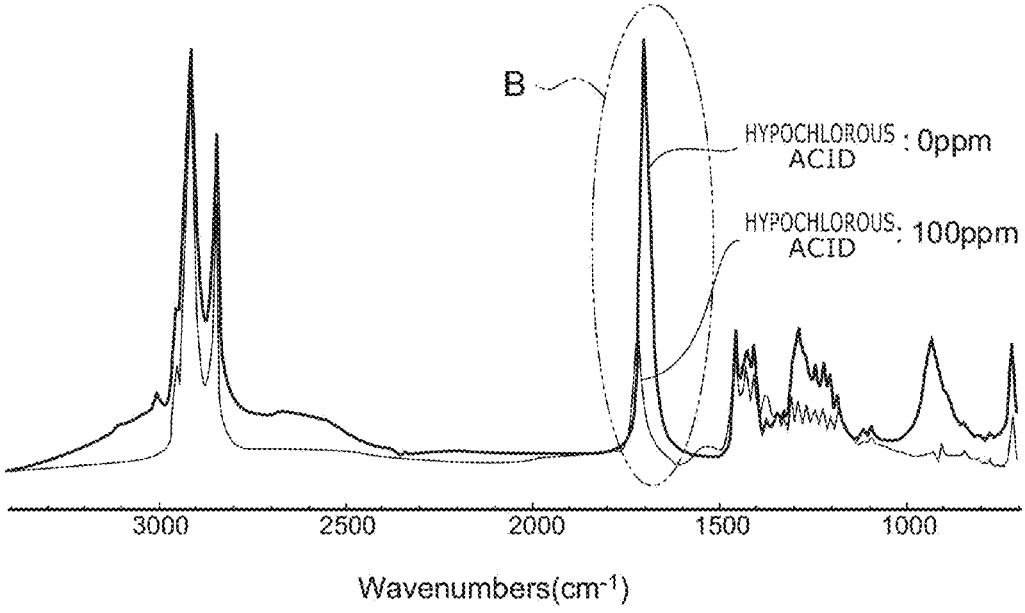
FIG. 6 is a graph illustrating decomposition effects of hypochlorous acid.

FIG. 5 and FIG. 6 are graphs illustrating decomposition effects of hypochlorous acid.

In the toilet apparatus 10 according to this embodiment, the control unit 405 executes a control to spray at least one selected from water and sterilizing water onto the surface of the bowl 801 of the toilet 800 from the spray nozzle 480 before the user uses the toilet 800 based on the detection result of the detection unit that detects the state of use of the toilet 800. For example, when the room entrance detection sensor 402 detects the user entering the toilet room, the control unit 405 executes a control to spray at least one selected from the water and the sterilizing water onto the surface of the bowl 801 of the toilet 800 from the spray nozzle 480. That is, the control unit 405 can execute a control to we the surface of the bowl 801 of the toilet 800 with the at least one selected from the water and the sterilizing water before the user uses the toilet 800.

Also, in the toilet apparatus 10 according to this embodiment, the control unit 405 executes a control to spray the sterilizing water onto the surface of the bowl 801 of the toilet 800 from the spray nozzle 480 after the user has used the toilet 800 based on the detection result of the detection unit that detects the state of use of the toilet 800. For example, the control unit 405 executes the control to spray the sterilizing water onto the surface of the bowl 801 of the toilet 800 from the spray nozzle 480 when a prescribed amount of time has passed from when the room entrance detection sensor 402 no longer detects the user to be in the toilet room. That is, the control unit 405 can execute the control to we the surface of the bowl 801 with the sterilizing water after the user has flushed the solid waste and finished using the toilet 800. In the description recited below, the case where the sterilizing water is hypochlorous acid water, i.e., a liquid including hypochlorous acid, is described as an example.

A bowl 801*a* of the comparative example illustrated in FIG. 3A to FIG. 3C will now be described.

The surface of the bowl 801*a* of the comparative example illustrated in FIG. 3A to FIG. 3C is not hydrophilic but is water-repellent. Here, "water-repellent" in the specification of the application refers to, for example, the property of having an affinity to water that is lower than that of the bowl surface of a toilet that has been provided with a glaze or the like or the property of easily repelling water. Therefore, a water film is not formed on the surface of the bowl 801*a* even in the case where the control unit 405 causes the water and/or the sterilizing water to be sprayed onto the surface of the bowl 801*a* from the spray nozzle 480 before the user uses the toilet 800. That is, the water and/or the sterilizing water that is sprayed onto the surface of the bowl 801*a* coalesces as, for example, water drops and the like and flows downward to the accumulated water surface.

Solid waste (feces) includes oil such as fatty acids, etc. For example, oleic acid, palmitic acid, stearic acid, and the like are examples of the components of the fatty acid included in feces. Therefore, as illustrated in FIG. 3A, solid waste 601 excreted by the user spreads to a wider range and adheres when striking the surface of the bowl 801*a* which is water-repellent. Continuing, when the control unit 405 causes hypochlorous acid water (sterilizing water) 651 to be sprayed from the spray nozzle 480 after the user has used the toilet 800, the hypochlorous acid water 651 adheres to the solid waste 601 that is adhered to the surface of the bowl 801*a* as illustrated in FIG. 3B.

Here, as a result of investigations of the inventor, it was ascertained that hypochlorous acid can decompose oil such as fatty acids, etc. As in the region of the double dot-dash line A illustrated in FIG. 5, this is confirmed by the decrease of the carbon-carbon double bonds due to hypochlorous acid having a concentration of 100 ppm. Also, as in the region of the double dot-dash line B illustrated in FIG. 6, the peak of oleic acid is confirmed to decrease due to hypochlorous acid having a concentration of 100 ppm.

Therefore, as illustrated in FIG. 3C, the hypochlorous acid water adhered to the solid waste 601 can decompose the upper portion of the solid waste 601 adhered to the surface of the bowl 801*a*.

However, because the water film is not formed on the surface of the bowl 801*a*, the contact surface area between the solid waste 601 and the surface of the bowl 801*a* is greater than the case where the water film is formed on the surface of the bowl. Further, because the surface of the bowl 801*a* is water-repellent and the water film is not formed on the surface of the bowl 801*a*, a contact angle θ1 between the surface of the bowl 801*a* and the oil of the solid waste 601 is smaller than that of the case where the water film is formed on the surface of the bowl. Here, "contact angle" in the specification of the application refers to the angle between a prescribed solid surface and liquid surface at the interface between the solid surface and the liquid surface and is the angle measured on the liquid side.

Therefore, the hypochlorous acid water 651 cannot reach the lower portion of the solid waste 601 adhered to the surface of the bowl 801*a*. Thereby, as illustrated in FIG. 3C, there is a risk that the lower portion of the solid waste 601 adhered to the surface of the bowl 801*a* may not be decomposed by the hypochlorous acid and may remain on the surface of the bowl 801*a*. Alternatively, there is a risk that oil such as the fatty acids, etc., included in the solid waste 601 may remain on the surface of the bowl 801*a*, and a covering film of oil may be formed on the surface of the bowl 801*a*.

Because oil becomes a nutrient of bacteria, there is a risk that bacteria may propagate in the case where the oil remains on the surface of the bowl 801*a*. In the case where bacteria propagates, for example, bacteria and collections of secretions of the bacteria called biofilms and the like are formed. When the solid waste 601 strikes the surface of the bowl 801*a* where a biofilm is formed, there are cases where the solid waste 601 affixes to the surface of the bowl 801*a*. In such a case, it becomes difficult to peel the solid component of the solid waste 601 from the surface of the bowl 801*a* by general toilet washing.

Conversely, the surface of the bowl 801 of this embodiment is hydrophilic. Therefore, as illustrated in FIG. 4A, a water film 653 can be formed on the surface of the bowl 801 before the solid waste 601 excreted by the user strikes the surface of the bowl 801 by the control unit 405 causing the water and/or the sterilizing water to be sprayed onto the surface of the bowl 801 from the spray nozzle 480 before the user uses the toilet 800. The oil of the solid waste 601 is peeled from the surface of the bowl 801 by being repelled by the water film 653 or by the buoyancy of the oil itself. Thereby, the adhesion or affixation of the solid waste 601 onto the surface of the bowl 801 can be suppressed.

Even in the case where the solid waste 601 remains on the surface of the bowl 801 as illustrated in FIG. 4A, the oil of the solid waste 601 is repelled by the water film 653 because the water film 653 is formed on the surface of the bowl 801. Therefore, a contact angle θ2 between the surface of the bowl 801 and the oil of the solid waste 601 of this embodiment is larger than a contact angle θ1 (referring to FIG. 3A) of the case where the water film is not formed on the surface of the bowl. Therefore, as illustrated in FIG. 4B, when the control unit 405 causes the hypochlorous acid water 651 to be sprayed from the spray nozzle 480 after the user has used the toilet 800, the hypochlorous acid water 651 adheres to the solid waste 601 adhered to the surface of the bowl 801 and reaches or extends around to the lower portion of the solid waste 601. In other words, the hypochlorous acid water 651 can exist around the oil of the solid waste 601.

Therefore, as illustrated in FIG. 4C, the hypochlorous acid can decompose the upper portion and the lower portion of the solid waste 601 adhered to the surface of the bowl 801. Thereby, the oil of the solid waste 601 adhered to the surface of the bowl 801 can be efficiently decomposed; and the solid waste 601 remaining on the surface of the bowl 801 can be suppressed. Also, the formation of the covering film of oil on the surface of the bowl 801 due to the oil of the solid waste 601 remaining on the surface of the bowl 801 can be suppressed. Therefore, the affixation of the solid waste 601 and the propagation of the bacteria caused by the oil of the solid waste 601 can be suppressed; and the cleanliness of the surface of the bowl 801 can be maintained.

Further, because the adhesion of the solid waste 601 to the surface of the bowl 801 is suppressed by the water film 653 being formed on the surface of the bowl 801, the region where the solid waste 601 is not adhered to the surface of the bowl 801 is larger than that of the case where the water film is not formed on the surface of the bowl. Therefore, the hypochlorous acid water 651 is adhered or fixed to the region where the solid waste 601 is not adhered to the surface of the bowl 801 more easily than in the case where the water film is not formed on the surface of the bowl. Therefore, the hypochlorous acid water 651 exists around the oil of the solid waste 601 more easily than in the case where the water film is not formed on the surface of the bowl. Thereby, the oil of the solid waste 601 adhered to the surface of the bowl 801 can be decomposed more efficiently.

The hypochlorous acid is utilized to decompose the solid waste 601 remaining on the surface of the bowl 801. Therefore, the production amount of the hypochlorous acid water can be reduced. Thereby, the load of the electrolytic cell that produces the hypochlorous acid water can be reduced; and a shorter life of the electrolytic cell can be suppressed. The electrolytic cell that produces the hypochlorous acid water is elaborated later.

Also, as described above in regard to FIG. 1 and FIG. 2, the spray nozzle 480 can spray the water and/or the sterilizing water in a mist-like form. Therefore, the water and/or the sterilizing water sprayed from the spray nozzle 480 adheres evenly to a wider range of the surface of the bowl 801. Thereby, the adhesion or affixation of the solid waste 601 to the surface of the bowl 801 can be suppressed more efficiently. Further, the sterilizing water sprayed from the spray nozzle 480 can be positioned around the solid waste 601 remaining on the surface of the bowl 801. Therefore, the oil of the solid waste 601 adhered to the surface of the bowl 801 can be decomposed more efficiently.

An example of results of experiments performed by the inventor will now be described with reference to the drawings.

FIG. 7 is a result table illustrating an example of results of experiments performed by the inventor for the removal time of solid waste.

The inventor caused pseudo solid waste to adhere to test pieces having prescribed surface properties and subsequently rinsed away the pseudo solid waste. The pseudo solid waste included oleic acid which is a component of the solid waste and had properties approximating those of solid waste. The inventor photographed the surface of each of the test pieces after rinsing away the pseudo solid waste. The inventor measured the time necessary to remove the pseudo solid waste adhered to the test piece for each of the test pieces. The surface photographs illustrated in FIG. 7 are examples of surface photographs of the test pieces. The removal times (seconds) illustrated in FIG. 7 are examples of the time necessary to remove the pseudo solid waste 601 adhered to the test pieces.

The surfaces were hydrophilic for test pieces 810 for samples (1) and (2). For the test piece 810 of sample (2), the inventor caused water to spray onto the surface of the test piece 810 prior to causing the pseudo solid waste 601 to adhere to the test piece 810. Therefore, the water film 653 was formed on the surface of the test piece 810 of sample (2). In the surface state illustrated in FIG. 7 for the test piece 810 of sample (2), the water film 653 exists in a state of water drops.

A test piece 810*a* of sample (3) (the first comparative example) was formed by utilizing, for example, a photocatalyst and the like. The surface of the test piece 810*a* formed by utilizing the photocatalyst and the like is called, for example, "super-hydrophilic." Accordingly, sample (3) was more hydrophilic than sample (1). The pseudo solid waste 601 was adhered to the surface of a test piece 810*b* of sample (4) (the second comparative example). Also, a pseudo-biofilm 657 was formed on the pseudo solid waste 601 adhered to the surface of the test piece 810*b*. Biofilms are made of proteins, amino acid derivatives, and polysaccharides. Therefore, commercial gum syrup that includes proteins, amino acid derivatives, and polysaccharides is substitutable; and gum syrup was covered and evaluated as the pseudo-biofilms (for convenience of description hereinbelow, the pseudo-biofilms are called simply biofilms). The biofilm 657 was formed on the surface of the test piece 810*b* of sample (5) (the third comparative example). Then, the pseudo solid waste 601 was adhered to the biofilm 657 formed on the surface of the test piece 810*b*.

According to the results of this experiment, the removal time of the test pieces 810 that were hydrophilic (samples (1) and (2)) were shorter than the removal times of the test pieces 810*b* (samples (4) and (5)) on which the biofilms were formed. Therefore, it can be seen that the adhesion or affixation of the pseudo solid waste 601 to the surface of the bowl 801 can be suppressed more for the test pieces 810 which were hydrophilic than for the test pieces 810*b* on which the biofilms were formed. Also, the removal time for sample (2) was shorter than the removal time for sample (1). Therefore, it can be seen that the adhesion or affixation of the pseudo solid waste 601 to the surface of the test piece 810 can be suppressed and the removal time can approach that of the test piece 810*a* (sample (3)) which was super-hydrophilic by causing water to be sprayed onto the surface of the test piece 810 prior to the pseudo solid waste 601 contacting the surface of the test piece 810.

In the case where the biofilm 657 was formed on the pseudo solid waste 601 as illustrated in the surface photograph of sample (4), the pseudo solid waste 601 remained on the test piece 810*b* even after the pseudo solid waste 601 was rinsed away for 294 seconds. Therefore, it can be seen that it is difficult to rinse away the pseudo solid waste 601 in the case where the biofilm 657 is formed.

Figure 8:
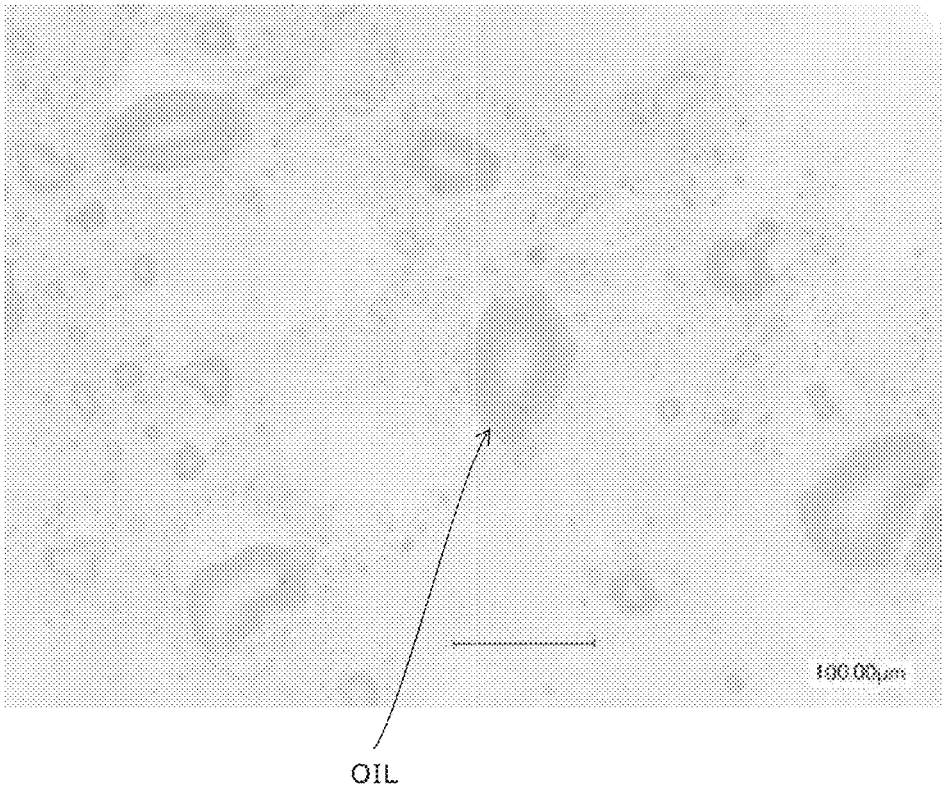
FIG. 8 is a photograph illustrating an example of the oil of the pseudo solid waste remaining on the surface of the test piece.

FIG. 8 is a photograph illustrating an example of the oil of the pseudo solid waste remaining on the surface of the test piece.

Figure 9:
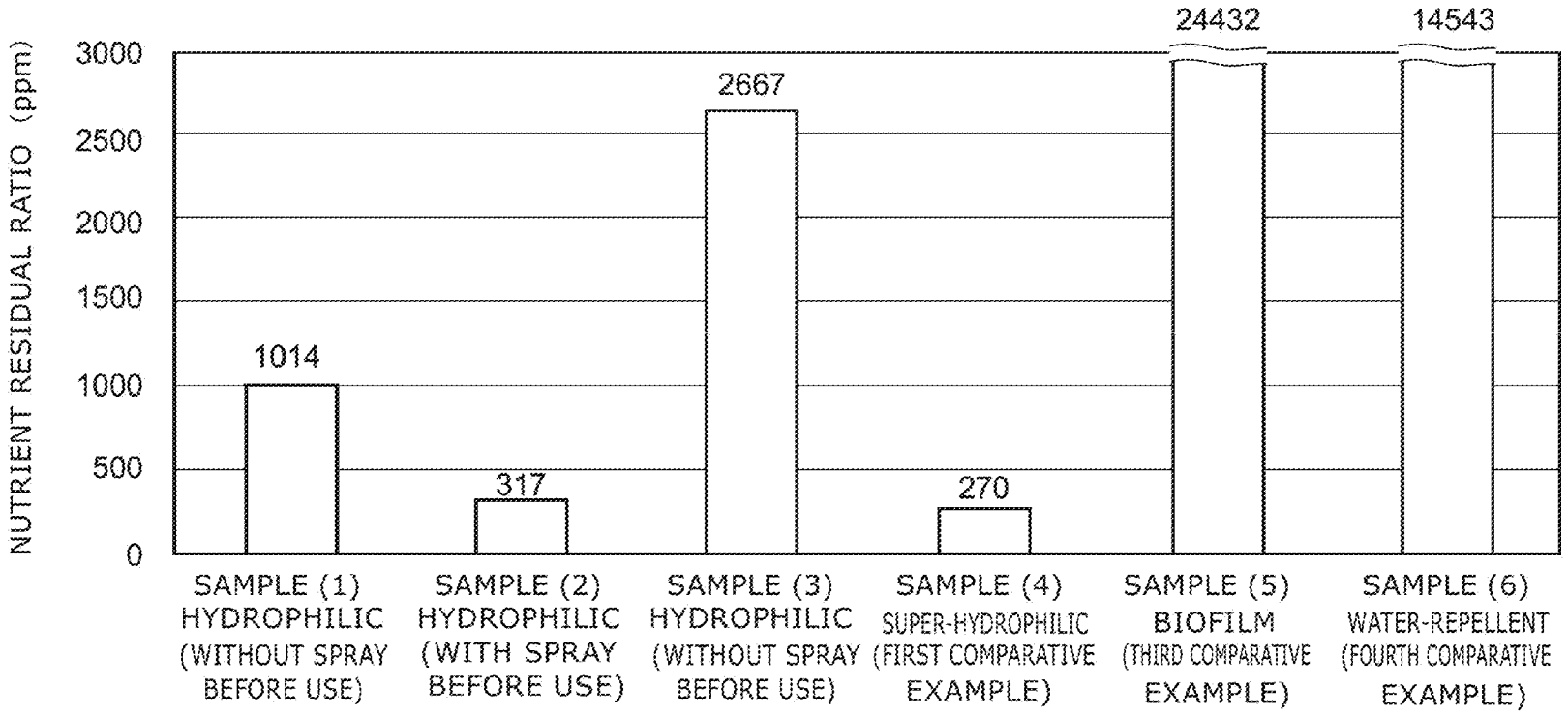
FIG. 9 is a graph illustrating an example of results of experiments performed by the inventor for the nutrient residual ratio.

FIG. 9 is a graph illustrating an example of results of experiments performed by the inventor for the nutrient residual ratio.

The inventor caused a pseudo solid waste containing a prescribed amount of oleic acid to adhere to test pieces having prescribed surface properties and subsequently rinsed the pseudo solid waste away by spraying water for a prescribed amount of time. Then, the inventor measured the nutrient residual ratio after rinsing away the pseudo solid waste by measuring the concentration of the oleic acid remaining on the surfaces of the test pieces.

As illustrated in FIG. 8, even in the case where the pseudo solid waste was rinsed away, the oil of the pseudo solid waste remained on the surfaces of the test pieces. The inventor measured the concentration of the nutritional components, i.e., the nutrient residual ratio, included in the oil of the pseudo solid waste that remained on the surfaces of the test pieces. The nutrient residual ratio of the surface of the test piece corresponds to the bacteria growth rate at the surface of the test piece. Examples of the nutrient residual ratios of the surfaces of the test pieces are as illustrated in the graph of FIG. 9. The photograph of FIG. 8 is an enlarged photograph of the surface of sample (1) illustrated in FIG. 9.

The surfaces of the test pieces of samples (1) and (2) are hydrophilic, that is, have surface properties similar to those of the test pieces 810 of samples (1) and (2) described above in regard to FIG. 7. For the test piece of sample (2), the inventor caused water to spray onto the surface of the test piece prior to causing the pseudo solid waste 601 to adhere to the test piece. Therefore, the water film 653 was formed on the surface of the test piece of sample (2). This is similar to sample (2) described above in regard to FIG. 7.

The surface of the test piece of sample (3) was hydrophilic. However, the surface of the test piece of sample (3) was not as hydrophilic as the surfaces of the test pieces of samples (1) and (2). The surface property of the test piece of sample (3) is within the range of the surface property of the bowl 801 of the toilet 800 of this embodiment.

The test piece of sample (4) (the first comparative example) was similar to that of sample (3) (the first comparative example) described above in regard to FIG. 7. That is, the surface of the test piece of sample (4) was super-hydrophilic. The test piece of sample (5) (the third comparative example) was similar to that of sample (5) (the third comparative example) described above in regard to FIG. 7. That is, a biofilm was formed on the surface of the test piece of sample (5). The surface of the test piece of sample (6) (the fourth comparative example) had a water-repellent covering film on a hydrophilic surface and was water-repellent.

According to the results of this experiment, the nutrient residual ratios of the surfaces of the test pieces of samples (1) to (3) which were hydrophilic were lower than the nutrient residual ratios of the surfaces of the test pieces of samples (5) and (6) which had a biofilm and was water-repellent, respectively. Therefore, it can be seen that the propagation of the bacteria can be suppressed more for the test pieces of samples (1) to (3) which were hydrophilic than for the test pieces of samples (5) and (6) which had a biofilm and was water-repellent, respectively. Further, it can be seen that the residual amount of the oil which becomes the nutrient of the bacteria can be suppressed more for the test pieces of samples (1) to (3) which were hydrophilic than for the test pieces of samples (5) and (6) which had a biofilm and was water-repellent, respectively.

Also, the nutrient residual ratio of the surface of the test piece of sample (2) was lower than the nutrient residual ratio of the surface of the test piece of sample (1). Therefore, it can be seen that the propagation of the bacteria at the surface of the test piece can be suppressed to approach the nutrient residual ratio of the surface of the test piece (sample (4)) that was super-hydrophilic by causing water to be sprayed onto the surface of the test piece prior to the pseudo solid waste 601 contacting the surface of the test piece.

The nutrient residual ratio of the surface of the test piece of sample (5) was higher than the nutrient residual ratio of the surface of the test piece of sample (6). Therefore, it can be seen that it is difficult to suppress the propagation of the bacteria in the case where a biofilm is formed as in the surface of the test piece of sample (5).

Figure 10:
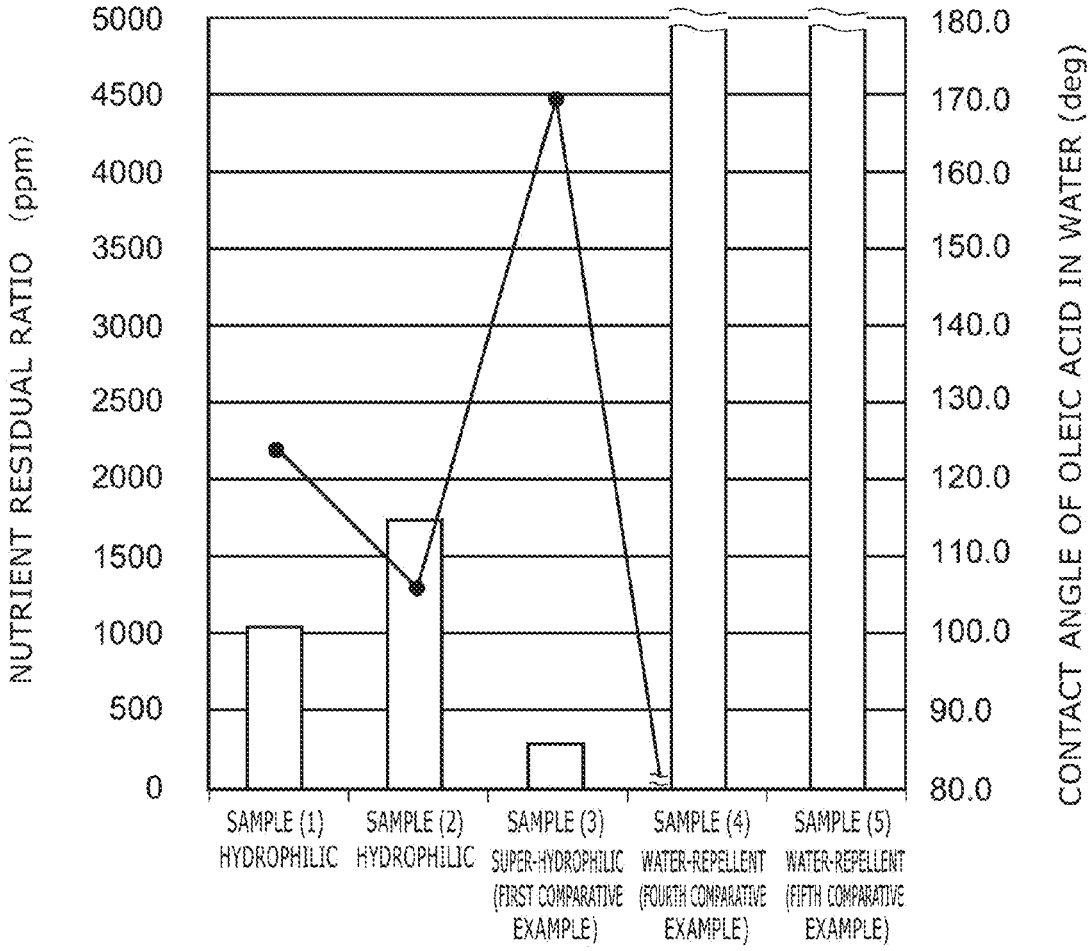
FIG. 10 is a graph illustrating an example of results of experiments performed by the inventor for the nutrient residual ratio and the contact angle of oleic acid in water.

FIG. 10 is a graph illustrating an example of results of experiments performed by the inventor for the nutrient residual ratio and the contact angle of oleic acid in water.

Figure 11:
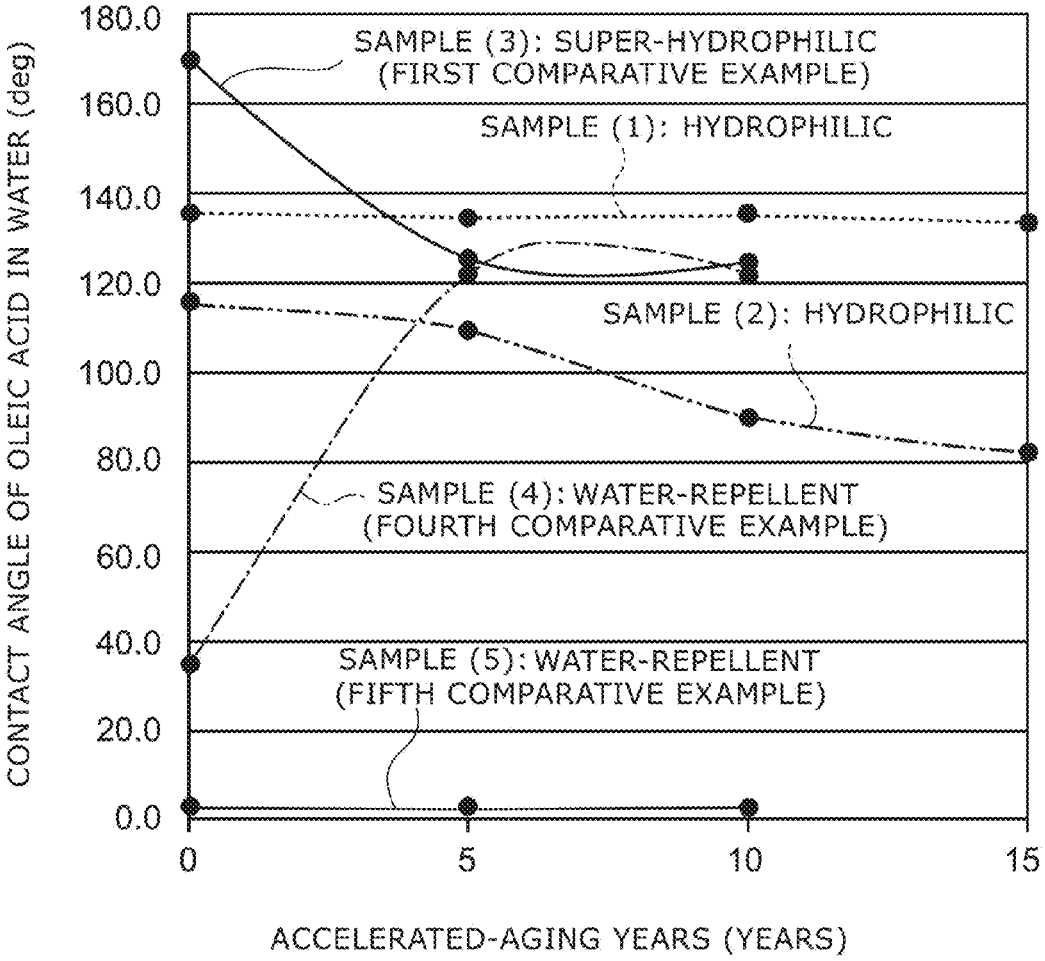
FIG. 11 is a graph illustrating an example of results of experiments performed by the inventor for the accelerated-aging years and the contact angle of oleic acid in water.

FIG. 11 is a graph illustrating an example of results of experiments performed by the inventor for the accelerated-aging years and the contact angle of oleic acid in water.

The contact angle in water was measured using a contact angle meter (automatic contact angle meter DM-500 made by Kyowa Interface Science Co., Ltd.) by immersing the test piece in a water tank in a state in which oleic acid had been dropped onto the test piece and by measuring the contact angle between the oleic acid and the test piece in this state.

The inventor measured the relationship between the nutrient residual ratio and the contact angle of oleic acid in water for the surface of the test piece. Here, "contact angle in water" in the specification of the application refers to the contact angle when in water. The contact angle in water of oleic acid, which is one component of the fatty acids included in feces, is different from the contact angle when in air. As described above in regard to FIG. 4A to FIG. 4C, the water film 653 is formed by the control unit 405 of this embodiment causing the water and/or the sterilizing water to be sprayed onto the surface of the bowl 801 of the toilet 800 before the user uses the toilet 800. Therefore, the inventor considered that the evaluation of the contact angle of oleic acid in water to be more appropriate than the evaluation of the contact angle of oleic acid in air. The method for measuring the nutrient residual ratio of the surface of the test piece is as described above in regard to FIG. 8 and FIG. 9.

An example of the relationship between the nutrient residual ratio and the contact angle of oleic acid in water for the surface of the test piece is as illustrated in the graph of FIG. 10. The surfaces of the test pieces of samples (1) and (2) were hydrophilic, that is, had surface properties similar to that of the test piece 810 of sample (1) described above in regard to FIG. 7. The surface of the test piece of sample (2) was not as hydrophilic as the surface of the test piece of sample (1). The surface property of the test piece of sample (2) was within the range of the surface property of the bowl 801 of the toilet 800 of this embodiment.

The test piece of sample (3) (the first comparative example) was similar to that of sample (3) (the first comparative example) described above in regard to FIG. 7. That is, the surface of the test piece of sample (3) was super-hydrophilic. The test piece of sample (4) (the fourth comparative example) was similar to that of sample (6) (the fourth comparative example) described above in regard to FIG. 9. That is, the surface of the test piece of sample (4) was water-repellent. The surface of the test piece of sample (5) (the fifth comparative example) was made of an acrylic resin and was water-repellent.

An example of the contact angle of oleic acid in water for the surface of the test piece of sample (1) was, for example, about 123.9 degrees. An example of the contact angle of oleic acid in water for the surface of the test piece of sample (2) was, for example, about 106.0 degrees. An example of the contact angle of oleic acid in water for the surface of the test piece of sample (3) was, for example, about 169.4 degrees. An example of the contact angle of oleic acid in water for the surface of the test piece of sample (4) was, for example, about 33.1 degrees. An example of the contact angle of oleic acid in water for the surface of the test piece of sample (5) was, for example, about 2.5 degrees.

It can be seen that, according to the results of this experiment, the nutrient residual ratio decreases as the contact angle of oleic acid in water increases. As described above in regard to FIG. 4A to FIG. 4C, this is because the water and/or the sterilizing water can exist around the oil of the solid waste 601 in the case where the contact angle of oleic acid in water is larger. Therefore, the ease of peeling the oil of the solid waste 601 from the surface of the test piece increases as the contact angle of oleic acid in water increases. Alternatively, the contact surface area between the oleic acid and the test piece decreases in the case where the contact angle of oleic acid in water is larger. Therefore, the oil of the solid waste 601 is decomposed more effectively and peeled more easily by the hypochlorous acid water 651 as the contact angle of oleic acid in water increases. Thereby, it can be seen that the propagation of the bacteria can be suppressed for the test pieces (samples (1) and (2)) which were hydrophilic and for which the contact angles of oleic acid in water on the surface were large. Therefore, it is desirable for the contact angle of oleic acid in water on the surface of the bowl 801 to be larger.

Here, the surface property of the bowl 801 of the toilet 800 changes due to the number of years of use of the toilet 800. More specifically, the contact angle of oleic acid in water on the surface of the bowl 801 changes due to the number of years of use of the toilet 800. The inventor implemented an accelerated aging test and measured the relationship between the accelerated-aging years and the contact angle of oleic acid in water.

First, the inventor made a solution of sodium hydroxide (NaOH) having a mass percentage of 5 wt %. Continuing, the inventor set the solution of the sodium hydroxide that was made to be 70° C. and immersed the test pieces in the solution. When a test piece is immersed for one hour in the solution of the sodium hydroxide that was made having these conditions, this corresponds to the test piece (the toilet 800) being used for one year.

An example of the relationship between the accelerated-aging years and the contact angle of oleic acid in water is as illustrated in the graph of FIG. 11. Samples (1) to (5) illustrated in FIG. 11 correspond to samples (1) to (5) described above in regard to FIG. 10, respectively. As in the graph of FIG. 11, it can be seen that the contact angles of oleic acid in water for the surfaces of the test pieces of samples (2) and (3) decrease from the initial state (accelerated-aging years: 0 years). It can be seen that for the surface of the test piece of sample (4), the contact angle of oleic acid in water increases once from the initial state (accelerated-aging years: 0 years) and subsequently decreases as the accelerated-aging years goes from 5 years to 10 years. This is considered to be because the water-repellent covering film of the surface was removed and the hydrophilic surface under the water-repellent covering film was exposed. It can be seen that, for the surfaces of the test pieces of samples (1) and (5), the contact angles of oleic acid in water are substantially maintained at the initial state (accelerated-aging years: 0 years).

The contact angles of oleic acid in water illustrated in FIG. 10 are the contact angles of oleic acid in water for the surfaces of the test pieces at the initial state (accelerated-aging years: 0 years). When considering this, it is desirable for the contact angle of oleic acid in water to be not less than about 90 degrees in the initial state. Further, it is more desirable for the contact angle of oleic acid in water to be not less than about 110 degrees and even more desirable to be not less than about 120 degrees in the initial state. Thereby, the hypochlorous acid water 651 can exist around the oil of the solid waste 601. Therefore, the oil of the solid waste 601 adhered to the surface of the bowl 801 can be efficiently decomposed. Further, the affixation of the solid waste 601 and the propagation of the bacteria caused by the oil of the solid waste 601 can be suppressed; and the cleanliness of the surface of the bowl 801 can be maintained.

Figure 12:
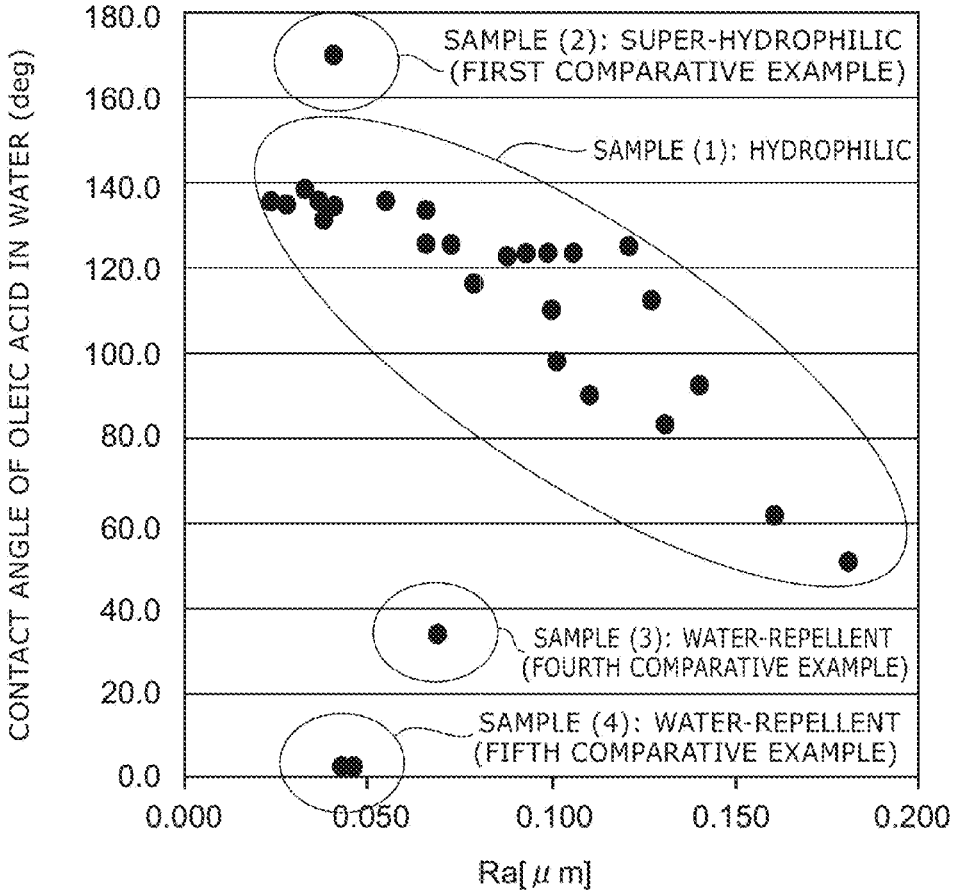
FIG. 12 is a graph illustrating an example of results of experiments performed by the inventor for the surface roughness and the contact angle of oleic acid in water.

FIG. 12 is a graph illustrating an example of results of experiments performed by the inventor for the surface roughness and the contact angle of oleic acid in water.

The inventor measured the relationship between the surface roughness Ra (the arithmetic average roughness Ra) and the contact angle of oleic acid in water for the test pieces. An example of the relationship between the surface roughness Ra and the contact angle of oleic acid in water for the test pieces is as illustrated in the graph of FIG. 12.

The surface roughness Ra is a value from measuring the test pieces using a surface roughness meter (portable surface roughness measuring instrument SJ-400 made by Mitutoyo Corporation).

Sample (1) was hydrophilic, that is, had a surface property similar to that of the test piece 810 of sample (1) described above in regard to FIG. 7. The test piece of sample (2) (the first comparative example) was similar to that of sample (3) (the first comparative example) described above in regard to FIG. 7. That is, the surface of the test piece of sample (2) was super-hydrophilic. The test piece of sample (3) (the fourth comparative example) was similar to that of sample (6) (the fourth comparative example) described above in regard to FIG. 9. That is, the surface of the test piece of sample (3) was water-repellent. The test piece of sample (4) (the fifth comparative example) was similar to that of sample (5) (the fifth comparative example) described above in regard to FIG. 10 and FIG. 11. That is, the surface of the test piece of sample (4) was water-repellent.

It can be seen that, according to the results of this experiment, there is a correlation between the surface roughness Ra and the contact angle of oleic acid in water for the test piece (sample (1)) which was hydrophilic. More specifically, it can be seen that there is a tendency for the contact angle of oleic acid in water to increase as the surface roughness Ra decreases for the test piece (sample (1)) which was hydrophilic.

When considering the contact angles of oleic acid in water described above in regard to FIG. 10 and FIG. 11 and the example of the relationship between the surface roughness Ra and the contact angle of oleic acid in water illustrated in FIG. 12, it is desirable for the surface roughness of the bowl 801 to be not more than about 0.07 μm (microns). Further, it is more desirable for the surface roughness of the bowl 801 to be not more than about 0.04 μm. Thereby, the hypochlorous acid water 651 can exist around the oil of the solid waste 601. Therefore, the oil of the solid waste 601 adhered to the surface of the bowl 801 can be efficiently decomposed. Further, the affixation of the solid waste 601 and the propagation of the bacteria caused by the oil of the solid waste 601 can be suppressed; and the cleanliness of the surface of the bowl 801 can be maintained.

A specific example of the sterilizing water production unit 450 of this embodiment will now be described with reference to the drawings.

Figure 13:
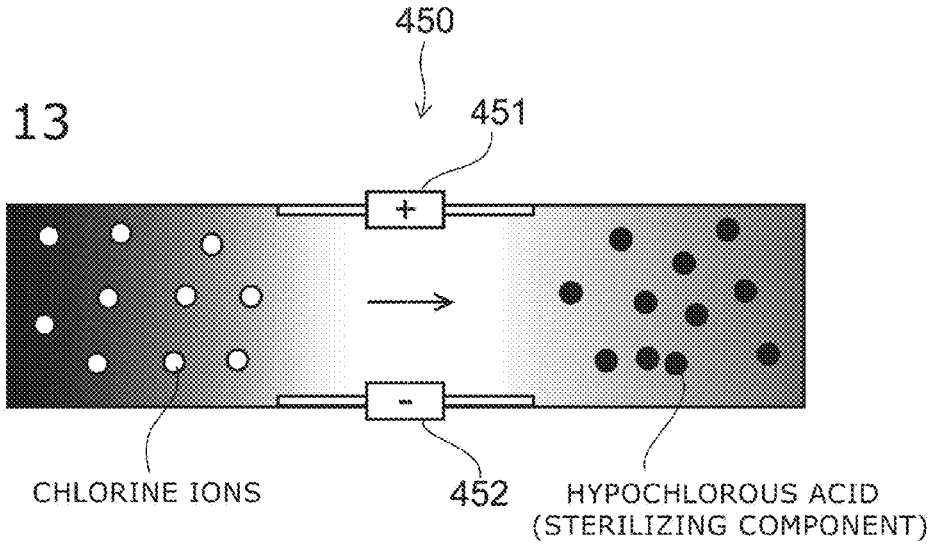
FIG. 13 is a schematic cross-sectional view illustrating the specific example of the sterilizing water production unit of this embodiment.

FIG. 13 is a schematic cross-sectional view illustrating the specific example of the sterilizing water production unit of this embodiment.

The sterilizing water production unit 450 of this embodiment is, for example, an electrolytic cell unit including an electrode.

As illustrated in FIG. 13, the sterilizing water production unit 450 of this specific example includes an anode plate 451 and a cathode plate 452 in the interior of the sterilizing water production unit 450 and can electrolyze service water flowing through the interior by a control of the conduction from the control unit 405. Here, the service water includes chlorine ions. These chlorine ions are included in water sources (e.g., groundwater, the water of dams, and the water of rivers and the like) as common salt (NaCl) and calcium chloride ($CaCl_2$). Therefore, hypochlorous acid is produced by electrolyzing the chlorine ions. As a result, the water (the electrolyzed water) electrolyzed in the sterilizing water production unit 450 changes into hypochlorous acid water.

The hypochlorous acid functions as a sterilizing component; and the hypochlorous acid water, i.e., the sterilizing water, can sterilize by efficiently removing or decomposing dirt due to ammonia and the like. Further, the hypochlorous acid water as described above can decompose oil such as the fatty acids, etc., included in feces.

According to this embodiment as described above, the surface of the bowl 801 of the toilet 800 is hydrophilic. The control unit 405 executes a control to cause at least one selected from water and sterilizing water to be sprayed onto the surface of the bowl 801 of the toilet 800 from the spray nozzle 480 before the user uses the toilet 800 based on the detection result of the detection unit that detects the state of use of the toilet 800. Further, the control unit 405 executes a control to cause the sterilizing water to be sprayed onto the surface of the bowl 801 of the toilet 800 from the spray nozzle 480 after the user has used the toilet 800 based on the detection result of the detection unit that detects the state of use of the toilet 800. Thereby, the adhesion or affixation of the solid waste 601 onto the surface of the bowl 801 can be suppressed. Also, the oil of the solid waste 601 adhered to the surface of the bowl 801 can be efficiently decomposed; and the solid waste 601 remaining on the surface of the bowl 801 can be suppressed. Further, the formation of the covering film of oil on the surface of the bowl 801 due to the oil of the solid waste 601 remaining on the surface of the bowl 801 can be suppressed. Therefore, the affixation of the solid waste 601 and the propagation of the bacteria caused by the oil of the solid waste 601 can be suppressed; and the cleanliness of the surface of the bowl 801 can be maintained.

Hereinabove, embodiments of the invention are described. However, the invention is not limited to these descriptions. Appropriate design modifications made by one skilled in the art in regard to the embodiments described above also are within the scope of the invention to the extent that the features of the invention are included. For example, the configurations, the dimensions, the materials, the dispositions, and the like of the components included in the toilet apparatus 10, the disposition method of the spray nozzle 480, and the like are not limited to those illustrated and may be modified appropriately.

Further, the components included in the embodiments described above can be combined within the extent of technical feasibility; and such combinations are included in the scope of the invention to the extent that the features of the invention are included.

INDUSTRIAL APPLICABILITY

According to the aspect of the invention, a toilet apparatus is provided that can suppress the affixation of the solid waste and the propagation of bacteria caused by oil and maintain the cleanliness of the bowl surface of the toilet.

REFERENCE SIGNS LIST

10 toilet apparatus
21 first flow channel
23 second flow channel
100 sanitary washing apparatus
200 toilet seat
300 toilet lid
400 casing
402 room entrance detection sensor
403 human body detection sensor
404 seat contact detection sensor
405 control unit
431 solenoid valve
450 sterilizing water production unit
451 anode plate
452 cathode plate
471 flow channel switch valve
480 spray nozzle
601 solid waste
651 hypochlorous acid water (sterilizing water)
653 water film
657 biofilm
800 toilet
801, 801*a* bowl
810, 810*a*, 810*b* test piece

What is claimed is:

1. A toilet apparatus, comprising:

a toilet, a bowl configured to receive solid waste being formed in the toilet, the bowl being hydrophilic;

a spray unit configured to spray at least one selected from water and hypochlorous acid water onto a surface of the bowl;

a detection unit including at least one of a room entrance detection sensor configured to detect a user entering a toilet room, a human body detection sensor configured to detect the user in front of a toilet seat provided on the toilet, and a seat contact detection sensor configured to detect the user seated on the toilet seat provided on the toilet; and a control unit configured to control to spray at least one selected from the water and the hypochlorous acid water from the spray unit before use of the toilet when the detection unit detects the user and to spray the hypochlorous acid water from the spray unit after use of the toilet when a prescribed amount of time passes from when the detection unit no longer detects the user.

2. The toilet apparatus according to claim 1, wherein the spray unit is a nozzle configured to spray the water and the hypochlorous acid water in a mist-like form.

3. The toilet apparatus according to claim 1, wherein a contact angle of oleic acid in water on the surface of the bowl is not less than 90 degrees.

4. The toilet apparatus according to claim 1, wherein an arithmetic average roughness Ra of the surface of the bowl is not more than 0.07 μm.

* * * * *